US006268781B1

(12) United States Patent
Schaffner

(10) Patent No.: US 6,268,781 B1
(45) Date of Patent: Jul. 31, 2001

(54) PLANAR WAVEGUIDE-TO-STRIPLINE ADAPTER

(75) Inventor: James H. Schaffner, Chatsworth, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/513,785

(22) Filed: Feb. 24, 2000

Related U.S. Application Data

(62) Division of application No. 08/927,505, filed on Sep. 10, 1997.

(51) Int. Cl.[7] ..... H01P 5/10
(52) U.S. Cl. ..... 333/26; 333/34; 333/254
(58) Field of Search ..... 333/26, 34, 254; 343/859

(56) References Cited

U.S. PATENT DOCUMENTS

| | | | | |
|---|---|---|---|---|
| 1,730,412 | | 10/1929 | Duncan, Jr. . | |
| 2,721,939 | * | 10/1955 | Hershfield et al. | 343/859 X |
| 3,323,063 | | 5/1967 | Walker et al. . | |
| 3,579,149 | * | 5/1971 | Ramsey | 333/26 |
| 3,882,396 | | 5/1975 | Schneider . | |
| 3,932,823 | | 1/1976 | Lavedan, Jr. et al. . | |
| 4,000,469 | | 12/1976 | McMaster . | |
| 4,183,054 | | 1/1980 | Patisaul et al. . | |
| 4,229,745 | | 10/1980 | Kruger . | |
| 4,290,068 | | 9/1981 | Bogner . | |

(List continued on next page.)

FOREIGN PATENT DOCUMENTS

| | | |
|---|---|---|
| 0 035 093 | 9/1981 | (EP) . |
| 0 383 292 | 8/1990 | (EP) . |
| 0 517 247 | 12/1992 | (EP) . |
| 2 710 195 | 3/1995 | (FR) . |
| 56-47183 | 4/1981 | (JP) . |
| 1-209825 | 8/1989 | (JP) . |
| 63-257337 | 10/1998 | (JP) . |

OTHER PUBLICATIONS

Klopfenstein, "A Transmission Line Taper of Improved Design," Proceedings of the IRE, pp. 31–35, Jan. 1956.*

Goyal "Designing A 100 MHZ Spare Dual Processor Using MCM–L Technology and Microwave Design Techniques" (1994) IEEE MTT–S International Microwave Symposium, Digest vol. 3, pp. 1715–1718.

Sakai, H., et al. "A Novel Millimeter–Wave IC on Si Substrate Using Flip–Chip Bonding Technology"(1994) IEEE MTT–S Digest, pp. 1763–1766.

Elliott, R.S. "An Improved Design Procedure for Small Arrays of Shunt Slots" pp. 48–53, IEEE Transactions on Antennas and Propagation, vol. AP–31, No. 1, Jan. 1983.

Lenkurt Electric Co., Inc. "The Lenkurt Demodulator: The CATV Video Microwave Link "(Feb. 1971) vol. 20, No. 2 pp. 2–7.

European TeleCommunication Standard, "Digital broadcasting systems for television, sound and data services: Satellite Master Antenna Television (SMATV) distribution systems "(1994) pp. 5–25.

*Primary Examiner*—Justin P. Bettendorf
(74) *Attorney, Agent, or Firm*—V. D. Duraiswamy; M. W. Sales

(57) ABSTRACT

A planar waveguide-to-microstrip adapter, a waveguide antenna and a downconverter all formed on a single dielectric substrate. The waveguide-to-stripline adapter is connected to the waveguide antenna and includes a tapered section attached to a microstrip line. The tapered section, which may be linear or may follow some other more complex taper function such as a Chebyshev function, adapts a signal propagating within the waveguide antenna to the microstrip line or vice versa.

12 Claims, 4 Drawing Sheets

U.S. PATENT DOCUMENTS

| | | |
|---|---|---|
| 4,439,784 | 3/1984 | Furukawa et al. . |
| 4,545,075 | 10/1985 | Miller et al. . |
| 4,710,956 | 12/1987 | Rast . |
| 4,745,377 | 5/1988 | Stern et al. . |
| 4,747,160 | 5/1988 | Bossard . |
| 5,071,787 | 12/1991 | Mori et al. . |
| 5,073,930 | 12/1991 | Green et al. . |
| 5,074,947 | 12/1991 | Estes et al. . |
| 5,173,775 | 12/1992 | Walker . |
| 5,214,501 | 5/1993 | Cavallerano et al. . |
| 5,227,812 | 7/1993 | Watanabe et al. . |
| 5,262,739 | 11/1993 | Dalman . |
| 5,272,525 | 12/1993 | Borchardt et al. . |
| 5,346,857 | 9/1994 | Scharr et al. . |
| 5,369,380 | 11/1994 | Ball et al. . |
| 5,374,938 | 12/1994 | Hatazawa et al. . |
| 5,375,146 | 12/1994 | Chalmers . |
| 5,381,307 | 1/1995 | Hertz et al. . |
| 5,394,559 | 2/1995 | Hemmie et al. . |
| 5,404,006 | 4/1995 | Schaffner et al. . |
| 5,412,720 | 5/1995 | Hoarty . |
| 5,414,394 | 5/1995 | Gamand et al. . |
| 5,483,663 | 1/1996 | Tawil . |
| 5,498,575 | 3/1996 | Onishi et al. . |
| 5,510,758 | 4/1996 | Fujita et al. . |
| 5,514,912 | 5/1996 | Ogashiva et al. . |
| 5,574,964 | 11/1996 | Hamlin . |
| 5,600,286 | 2/1997 | Livingston et al. . |
| 5,610,916 | 3/1997 | Kostreski et al. . |
| 5,613,190 | 3/1997 | Hylton . |
| 5,629,241 | 5/1997 | Matoubian et al. . |
| 5,757,074 | 5/1998 | Matloubian et al. . |
| 5,955,998 | 9/1999 | Roberts et al. . |

* cited by examiner

PLANAR WAVEGUIDE-TO-STRIPLINE ADAPTER

This is a division of parent application filed on Sep. 10, 1997 with Ser. No. 08/927,505.

BACKGROUND OF THE INVENTION (a) Field of the Invention

The present invention relates generally to a communication signal receiver/transmitter system and, more particularly, to a slot array antenna receiver system having a planar waveguide-to-microstrip adapter and a method of installing the same in a building.

(b) Description of Related Art

Satellite and ground based communication systems relay or send electronic communication signals, including audio, video, data, audio-visual, etc. signals, to or from any portion of a large geographical area, such as the continental United States. A satellite-based signal distribution system generally includes an earth station that modulates a carrier frequency with an audio/visual/data signal and then transmits (uplinks) the modulated signal to one or more, for example, geosynchronous satellites. The satellite(s) amplify the received signal, shift the signal to a different carrier frequency band and transmit (downlink) the frequency shifted signal to earth for reception at individual receiving units. Other known communication systems, such as cellular systems, use a number of transmitters spaced throughout a geographical region to relay communication signals to individual receiver units within the region. In some of these systems, the individual receiving units may transmit a signal via a satellite or other transmitter to a base station, an earth station, or to other receiving units. Still other communication systems send signals to receiver units within a smaller geographical area such as a city, a block, or a building, or send signals directly between two points.

Certain of these satellite and/or ground based communication systems, including some commercial and military mobile communication systems as well as a direct-to-home satellite system developed by DirecTV® (known commercially as DSS®), use microwave/millimeter wave carrier frequencies, such as Ku band (ranging from approximately 12 GHz to 18 GHz) to transmit a signal from a satellite or other transmitter to one or more receiver units and/or vise-versa. Communication systems may operate in the millimeter wave (mmW) range above Ku-band and, in some instances, provide free-space point-to-point communication using the 60 GHz carrier frequency range where high free-space propagation signal losses occur. It has been suggested, for example, to locate a parabolic dish antenna on an exterior portion of a building to receive a communication signal at, for example, Ku-band, and then to retransmit the communication signal at V-Band (e.g., at or near the 60 GHz carrier frequency region) to receiving antennas associated with a number of receiving units within the building via transmitters that overhang the roof of the building. Of course, other microwave/millimeter wave carrier frequency bands can be used to transmit other types of communication signals between other ground-based transmitters (such as those disposed on towers, buildings, etc.) and receivers.

In these communication system configurations, it is desirable to use a Ku-band, a V-band (e.g., 60 GHz), or other receiving/transmitting antenna located on the exterior of a building to receive signals from or to transmit signals to a satellite transmitter/receiver, a roof-mounted transmitter/receiver, or other transmitter/receiver. Mounting an antenna on an exterior of a building may be difficult however, especially when the building is a multiple dwelling unit like a multiple story apartment building, condominium, etc. that has no balconies or other easily accessible structures on which the antenna can be mounted. In these instances, an installer must scale the outside of the building or lean out of a window of the building, drill a hole into or through a wall of the building and mount the antenna in or near the hole in the wall. This activity can be dangerous and time consuming and, in some cases, next to impossible without the aid of sophisticated ladders or other scaling equipment.

Furthermore, it is desirable that an exterior mounted antenna be compact so that it does not take up a lot of space at a receiver location, be low in profile so that it does not significantly deface the aesthetic appearance of the building on which it is mounted, and be relatively immune to environmental hazards such as rain, snow, etc. Still further, it is important that the antenna be inexpensive so that it may be used in widespread consumer-oriented communications applications, such as in satellite or other television signal communication systems.

It is known to use smaller dielectric loaded slot array antennas, such as those discussed in Robert S. Elliott, "An Improved Design Procedure for Small Arrays of Shunt Slots," IEEE Trans. Antennas Propagation, Vol. AP-31, No. 1, pp. 48–53 (Jan. 1983), or other dielectric loaded waveguide fed slot array antennas to receive microwave/millimeter wave signals. However, these antennas require the use of a waveguide-to-microstrip transition stage or adapter, such as one of those disclosed in Terry Edwards, "Foundations for Microstrip Circuit Design," 2nd Ed., pp. 233–239 (1992), which use a microstrip probe, a ridged waveguide transformer, or a fin-line to convert the received electric field from a waveguide to a microstrip transmission line where the receiver/transmitter modulator or demodulator is implemented. Unfortunately, these known waveguide-to-microstrip transition stages are generally complex, add significantly to the cost of an antenna/receiver system and are not easily coupled to a waveguide antenna in a compact manner or in a manner that enables the antenna to be conveniently mounted on the exterior of a building.

SUMMARY OF THE INVENTION

According to one aspect of the present invention, a signal receiver/transmitter includes a dielectric loaded planar waveguide fed slot array antenna formed on a substrate made of, for example, a continuous piece of polytetrafluoroethylene, and a waveguide-to-stripline adapter formed on the substrate at a point adjacent to the antenna. The waveguide antenna may be tuned to receive/transmit, for example, a millimeter wave signal or a microwave signal but, preferably, is tuned to receive/transmit a signal at a frequency range between about 59 gigahertz and about 64 gigahertz. The waveguide antenna may have a set of slots disposed in a surface thereof to form a beam pattern having a maximum gain lobe oriented approximately perpendicular to the surface of the antenna or, alternatively, oriented at an acute angle with respect to the surface of the antenna. A radome may be disposed over the antenna to protect the antenna from environmental elements such as rain and snow.

The waveguide-to-stripline adapter preferably includes a microstrip line and a taper section that adapts a signal propagating within the waveguide antenna to the microstrip line (or vise versa). The taper section may be designed to be linear or to follow some other more complex taper function such as a Chebyshev function.

In one embodiment, a downconverter circuit is disposed on the substrate adjacent the waveguide-to-stripline adapter and may be connected to the microstrip line or other type of stripline associated with the waveguide-to-stripline adapter. The downconverter operates to downconvert the signal received by the antenna to an intermediate frequency band, such as L-Band.

According to another aspect of the present invention, a waveguide-to-stripline adapter includes a planar dielectric substrate having four sides, each of which has a metal layer disposed thereon. The metal layer on the first side of the substrate includes a tapered section that tapers from a first width at one part of the substrate to a second width that is smaller than the first width at another part of the substrate. The smaller end of the tapered section is preferably connected to a microstrip line or other stripline which, in turn, is connected to a downconverter circuit formed on the substrate. The larger end of the tapered section may be connected to a dielectric loaded waveguide fed slot array antenna formed using the substrate. Preferably, the metal layers on the other three sides of the adapter cover the entire surfaces thereof.

Another aspect of the invention is a method of forming the waveguide-to-stripline adapter integrally on a single dielectric substrate adjacent to and coplanar with a waveguide antenna and a downconverter.

DESCRIPTION OF THE PREFERRED EMBODIMENTS

By the way of example only, the receiver system according to the present invention is described herein as constructed for use to receive a millimeter wave (generally considered to be between approximately 30 GHz and 300 GHz) communication signal and, more specifically, a V-band (approximately 50 GHz to 75 GHZ) communication signal, with a highly preferred use in the range of between approximately 59 GHz and 64 GHz where high free-space propagation losses occur due to atmospheric absorption. It should be understood, however, that the described receiver system can also or alternatively be used to transmit signals and that a receiver system constructed according to the principles disclosed herein can be used as a transmitter or as a receiver for any desired satellite or ground-based, audio, video, data, audio-visual, etc. signal distribution system or communication system, including those which use wavelengths less than the mmW range, such as sub-millimeter wave and terra-wave communication systems, and wavelengths greater than the mmW range, such as microwave (approximately 300 MHz to 30 GHz) communication systems.

Figure 1:
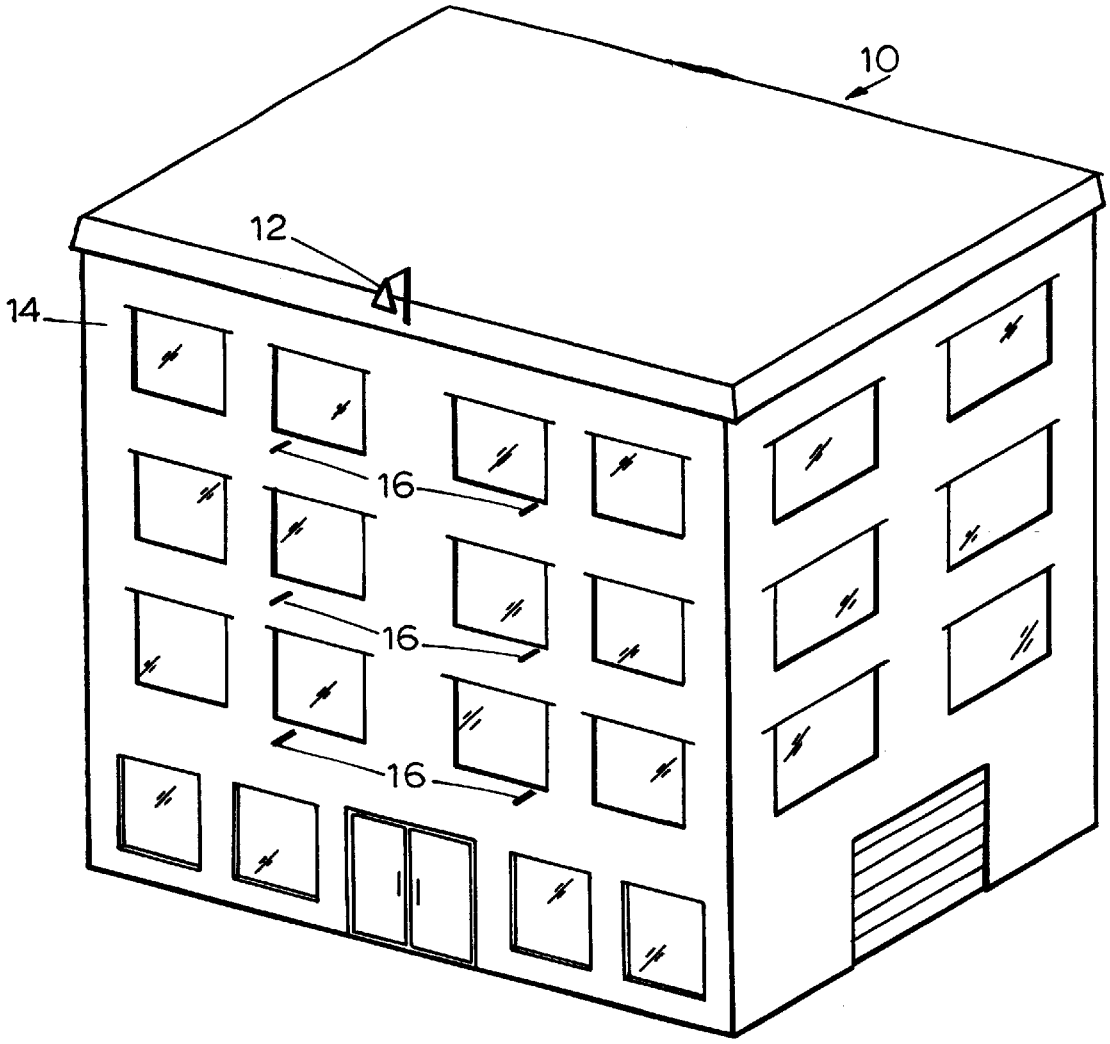
FIG. 1 is a perspective view of a multiple dwelling unit having a number of the receiver systems of the present invention installed therein.

Referring now to FIG. 1, a multiple dwelling unit (MDU) 10 which may be, for example, an apartment, townhome, or condominium complex, a hotel/motel, a multi-use building and/or any other type of building or structure in which multiple receivers may be located is illustrated as having a transmitter 12 disposed on the roof thereof. The transmitter 12 overhangs the roof of the MDU 10 and operates to relay a communication signal, such as a television, audio, data, or other type of communication signal along an exterior wall 14 of the MDU 10. The transmitter 12 may transmit the communication signal at any desired frequency such as any microwave/millimeter wave frequency including the Ku band but, preferably, transmits at the V-band range between approximately 59 GHz and 64 GHz. Because of the high propagation losses caused by the atmosphere in this region of the V-band, use of this region makes the transmitter 12 ideal for sending communication signals over a short distance, such as to receivers within the units of the MDU 10, without interfering with similar transmitters located in buildings situated nearby. Moreover, while the transmitter 12 is illustrated in FIG. 1 as being located on the roof of the MDU 10, the transmitter 12 could alternatively be located at any other desired position on or adjacent to the MDU 10, on other buildings or structures and, if desired, on a transmitter tower or a satellite. However, in some of these cases, use of the V-band (especially between 59 GHz and 64 GHz) would be undesirable or unpracticable due to the high propagation losses caused by the atmosphere in this region.

As illustrated in FIG. 1, one or more of the individual units within the MDU 10 along the wall 14 have a receiver system 16 according to the present invention extending from an exterior side of the wall 14 for receiving the communication signal transmitted by the transmitter 12. The receiver systems 16 receive signals from the transmitter 12, downconvert those signals to an intermediate frequency, such as L-Band (e.g., between 950 MHz and 1450 MHz), and provide the downconverted signals to a decoder or demodulator unit within the individual units of the MDU 10.

Figure 2:
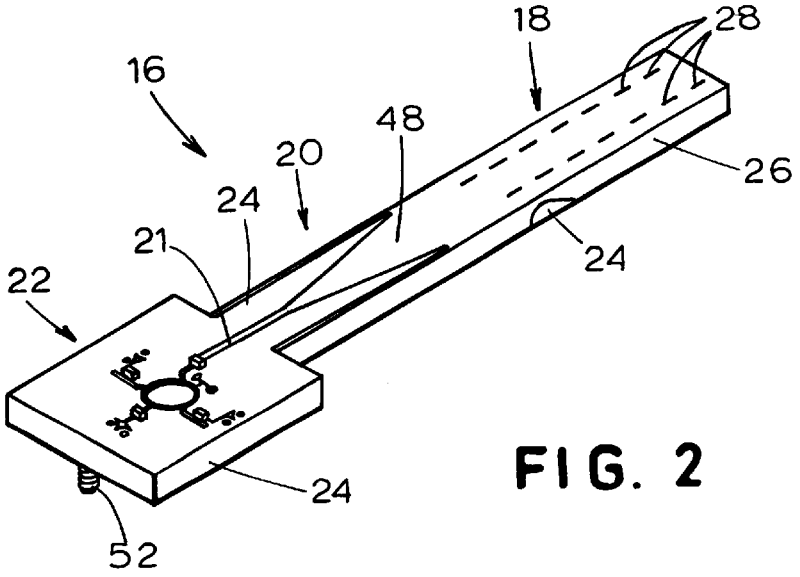
FIG. 2 is a perspective view of the receiver system of the present invention with a radome and a support mount removed.
Figure 3:
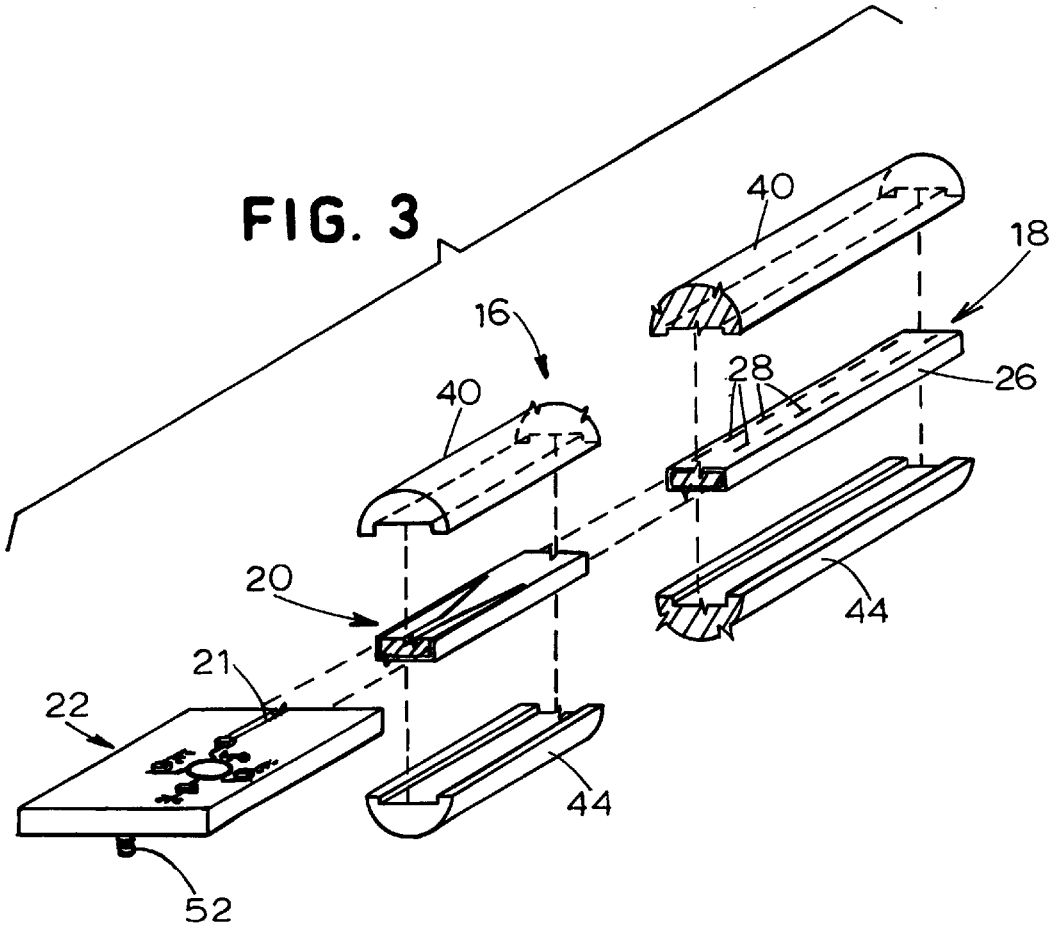
FIG. 3 is an exploded view of the receiver system of the present invention.

Referring now to FIGS. 2 and 3, the receiver system 16 of the present invention is illustrated in more detail. Generally speaking, the receiver system 16 includes a dielectric waveguide fed slot array antenna 18 that receives the signals transmitted by the transmitter 12, a planar waveguide-to-microstrip adapter 20 that adapts the received electromagnetic energy within the waveguide antenna 18 to a microstrip line 21, and a downconverter 22 that downconverts the signals within the microstrip line 21 to an intermediate frequency. As illustrated in FIG. 2, the antenna 18, the adapter 20, and the downconverter 22 are all formed on a continuous substrate 24 made of a dielectric material. Preferably, the dielectric material of the substrate 24 comprises a polytetrafluoroethylene (PTFE) material such as the RT/Duroid® 5880 PTFE composite material manufactured by Roger's Corporation, but may, instead, comprise any other desired low-loss dielectric material that can be conveniently used as a substrate during etching and/or milling operations associated with the manufacture of the receiver system 16.

As clearly illustrated in FIG. 2, the dielectric waveguide fed slot array antenna 18 includes a waveguide 26 formed around the dielectric substrate 24 (shown in cut-away section in FIG. 2). The waveguide 26 has sides which are formed of continuous strips or pieces of copper or other suitable metal and has an array of slots 28 or other antenna elements disposed on an upper surface thereof to detect the signal being transmitted by the transmitter 12. The slots 28 may have any standard length and/or width and may be formed in any known pattern to create an antenna beam of a desired shape for a particular frequency or frequency range. Preferably, the slots 28 are spaced apart by an integer multiple of $\lambda_g/2$ (where $\lambda_g$ is the signal wavelength within the dielectric substrate 24 of the waveguide 26 for the $TE_{10}$ mode), and are formed in a symmetrical pattern that alternates about a center line of the waveguide 26 to produce a symmetrical broadsided beam pattern (i.e., perpendicular to the array axis) for the antenna 18. Alternatively, the slots 28 may be spaced apart by some other distance to produce a uniform phase progression down the antenna 18 to thereby produce a beam pattern having a main lobe that is offset from broadside (i.e., at an acute angle with respect to the array axis).

As is generally known, $\lambda_g$ depends upon the frequency of the signal being received (or transmitted) and the dielectric constant of the substrate 24 according to the equation:

$$\lambda_g = \frac{\lambda_0 / \sqrt{\epsilon_r}}{\sqrt{1 - \left(\frac{\lambda_0 / \sqrt{\epsilon_r}}{2a}\right)^2}} \tag{1}$$

wherein:

$\lambda_g$=the center wavelength of the received signal within the substrate 24;

$\epsilon_r$=the dielectric constant of the substrate 24;

$\lambda_o$=the free-space wavelength of the received signal; and a=the width of the waveguide 26.

Thus, for example, when the antenna 18 has a PTFE substrate (with a dielectric constant of 2.2), a width of 2.5 mm and is tuned to receive signals at approximately 60 GHz, $\lambda_g$ is about 4.56 mm. In this case, the slots 28, which may be cut or otherwise etched into the metal surface of the waveguide 26 to expose an exterior surface of the PTFE substrate 24, may be located about 2.27 mm apart.

While the thickness (depth from the top) of the waveguide 26 does not effect $\lambda_g$, it does effect the waveguide insertion loss and, therefore, should be configured in conjunction with the impedance requirements of the microstrip line 21 of the downconverter 22. In the example given above, with a microstrip line 21 having an impedance of approximately 95 ohms, the thickness of the substrate 24 is best set at approximately 0.254 mm. However, other thicknesses may be used as well.

When the waveguide 26 has copper sides and the substrate 24 comprises the RT/Duroid 5880 material (having a dielectric loss tangent of approximately 0.001), the total calculated waveguide loss for a waveguide thickness of approximately 0.254 mm (10 mils) is about 0.23 dB/cm. Furthermore, if the antenna 18 includes an array of about 30 slots along the length thereof at a tuning frequency of about 60 GHz, the antenna 18 will have a length of about 7.0 cm. In such a case, the array factor directivity (calculated using the antenna array analysis program known commercially as PCAAD 3.0) is about 14 dB.

As indicated above, when formed using a PTFE substrate and used to receive 60 GHz center frequency signals, the waveguide 26 is preferably about 2.5 mm wide, about 7.0 cm long, and about 0.245 mm thick. However, other lengths, widths, and thicknesses for the waveguide 26, as well as other slot spacings or patterns, may be used instead, depending on the tuning frequency, the desired main lobe beam angle, the dielectric substrate material being used, the gain desired, the characteristics of the downconverter being used, etc.

As illustrated in FIG. 3, the receiver system 16 may include a radome 40 made of a low dielectric constant material such as acrylic disposed over the waveguide 26 and/or the adapter 20 to protect these elements from the environment. Likewise, the receiver system 16 may include a support mount 44 made of, for example, metal or rigid plastic attached to a lower portion of the waveguide 26 and the adapter 20 to support these elements. Preferably, the radome 40 and the support mount 44 are rigid and sturdy enough to withstand outdoor environmental hazards such as rain, snow, etc. and are sealed to prevent moisture from accumulating within or getting into the waveguide 26 and or the adapter 20.

The waveguide-to-stripline adapter 20 (illustrated in FIGS. 2, 3, and 4) is integrally formed on the substrate 24 adjacent to the waveguide 26 and is co-planar with the waveguide 26. As illustrated in FIGS. 2 and 3, a section of the waveguide 26 is disposed between the adapter 20 and the slots 28 of the antenna 18. This section may be of any desired length but, preferably, is as short as possible to reduce the insertion loss associated with the receiver system 16.

Figure 4:
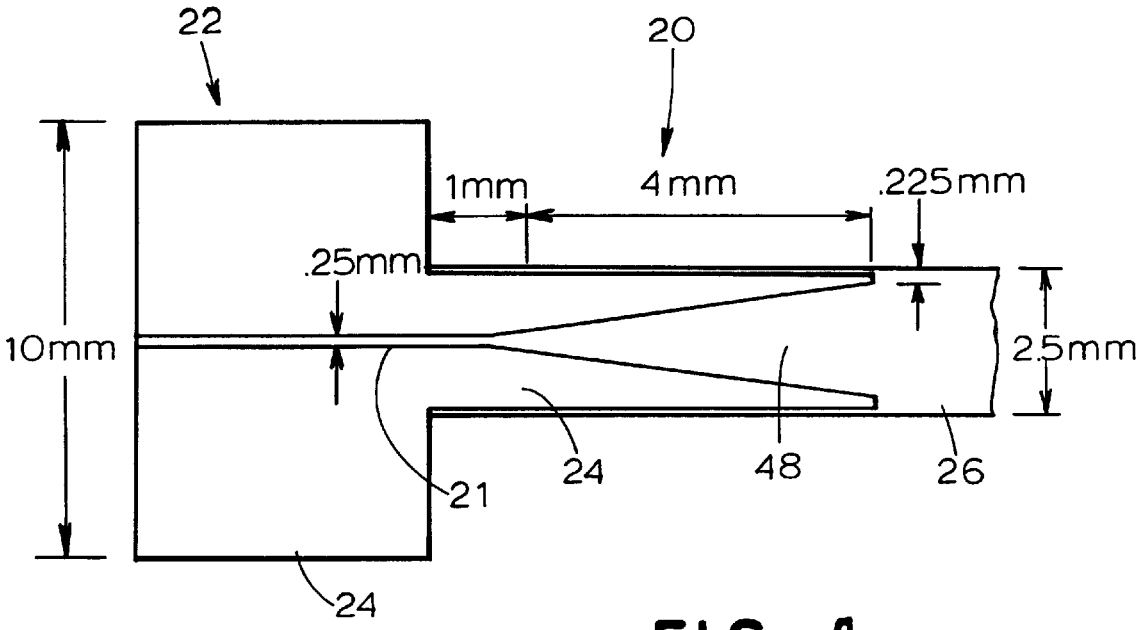
FIG. 4 is a top view of one embodiment of a waveguide-to-stripline adapter according to the present invention.

Generally, the adapter 20 is designed to minimize the insertion loss between the antenna 18 and the microstrip line 21 while producing a return loss that is as high as possible, so that only minimal amount of energy is reflected back toward the antenna 18. The adapter 20 includes metal layers (which may be integrally formed with the metal walls of the waveguide 26) covering the entire surface of three sides of the substrate 24 and a tapered metal layer 48 disposed on the upper side or surface thereof. As best illustrated in FIG. 4, a first end of the tapered metal layer 48 connects to and has the same width as an upper wall of the waveguide 26 while a second end of the tapered metal layer 48 connects to and has the same width as the microstrip line 21 or other stripline connected to the downconverter 22. As a result, the first end of the tapered metal layer 48 is wider than the second end thereof.

The tapered metal layer 48 may include a tapered section that begins with a 0.225 mm indent disposed perpendicular to the edge of the adapter 20 on both sides of the adapter 20. However, this indent is not strictly necessary. The tapered metal layer 48 then tapers away from both edges of the upper portion of the adapter 20 to expose the dielectric substrate 24. As illustrated in FIG. 4, the taper of the tapered metal layer 48 may be linear and may be about 4.0 mm in length to couple the signal in the waveguide 26 to the 0.2454 mm wide microstrip line 21. However, the tapered metal layer 48 may have other dimensions and/or may be tapered in any other desired manner including, for example, according to a Chebyshev function or an exponential function. Other possible taper functions are discussed in R. E. Collin, "Foundations for Microwave Engineering," pp. 248–251 (1966). It should be noted that a linear taper may taper over any desired length but that a Chebyshev taper allows the taper to be made over the shortest possible length.

Figure 5:
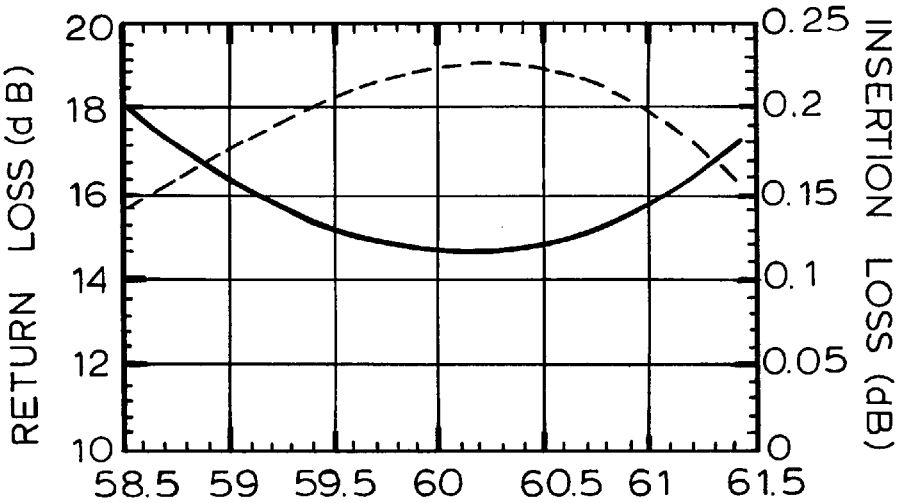
FIG. 5 is a graph illustrating the return loss and the insertion loss versus frequency of one embodiment of the receiver system of the present invention.

The chart of FIG. 5 illustrates the insertion loss and the return loss modeled for the adapter 20 of FIG. 4 (having a simple linear taper), wherein the insertion loss is illustrated in dotted line format and the return loss is illustrated in solid line format. The data of this chart was obtained using the electromagnetic field solving program commercially marketed by Ansoft Corporation as the Maxwell® Eminence program. As can be seen from FIG. 5, the insertion loss reaches a high of only about 0.23 dB near 60 GHz while the return loss is close to 15 dB at the same frequency. Over the 3 GHz frequency range modeled in the chart of FIG. 5, the return loss increases from its minimum value to approximately 18 dB while the insertion loss decreases to approximately 0.14 dB. The performance of the adapter 20 can be improved by using, for example, an appropriate Chebyshev function for the taper shape. In any event, FIG. 5 illustrates that the adapter 20 operates to couple the signal received by the antenna 18 to the microstrip line 21 in a manner that enables that signal to be detected and used by the downconverter 22.

Referring again to FIG. 2, the downconverter 22 downconverts the energy within the microstrip 21 to, for example, L-band and sends a signal out over a standard electrical cable through a coupling 52 to a signal demodulator or decoder associated with, for example, a television signal receiver system. The downconverter 22 may be constructed using any known or desired technology or design but, preferably, is formed directly on the PTFE substrate 24. In such a case, the downconverter 22 may be fabricated using a flip-chip fabrication technique such as that disclosed in Matloubian et al. U.S. Pat. No. 5,629,241 issuing May 13, 1997, (U.S. patent application Ser. No. 08/499,800, filed Jul. 7, 1995), entitled "Microwave/Millimeter Wave Circuit Structure with Discrete Flip-Chip Mounted Elements, and Method of Fabricating the Same," which is assigned to the assignee of the present invention and is hereby expressly incorporated by reference herein. The downconverter 22 may be any type of standard mixing circuit such as a retrace hybrid or ring-type balanced mixer. Of course, the downconverter 22 may be formed on the substrate 24 in any other desired manner or may be formed on other substrates and then connected to the microstrip line 21 using any known or desired technique.

The antenna 18, the adapter 20, and the downconverter 22 are described herein as being designed to receive V-band (60 GHz) signals so as to be used in point-to-point or short range communications applications and, thereby, to take advantage of the unlicensed frequency band between 59 and 64 GHz. However, as noted above, the dimensions, materials, and other properties of these components could be altered in any desired manner to receive and/or transmit other signals of other frequencies.

To manufacture the receiver system 16 described above, the upper and lower surfaces of a sheet of the dielectric substrate material 24 are first coated with a layer of metal, such as copper. The coated sheet of material is then cut into strips the width of the downconverter 22 and the length of the downconverter 22, adapter 20, and antenna 18. The edges of the sections of each strip associated with the adapter 20 and the antenna 18 are then cut away to make the substrate 24 at these locations the desired width. Next, a metal coating or layer is disposed on the sides of the substrate associated with the adapter 20 and the antenna 18. Thereafter, the slots 28 of the antenna 18 and the tapered metal layer 48 of the adapter 20 are etched or milled into the upper surfaces of these components to expose the surface of the substrate 24 at the appropriate locations. Likewise, unnecessary metal on the downconverter 22 may be removed. At a convenient time during this entire process, the circuitry associated with the downconverter 22 is placed on the substrate 24 using, for example, the flip-chip fabrication technique disclosed in Matloubian et al. Thereafter, the radome 40 and the support structure 44 are molded onto or otherwise attached to the antenna 18 and the adapter 20. A cover may then be placed on the downconverter 22, at which time the receiver system 16 may be tested and shipped.

Figure 6A:
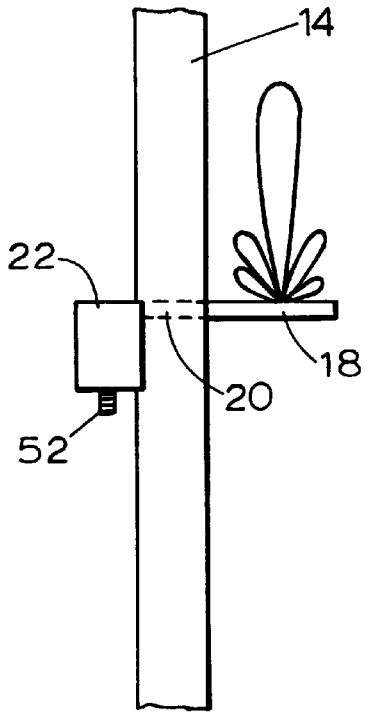
FIGS. 6A–6C are side views of a wall of a building having different embodiments of the receiver system installed therein according to the present invention.
Figure 6B:
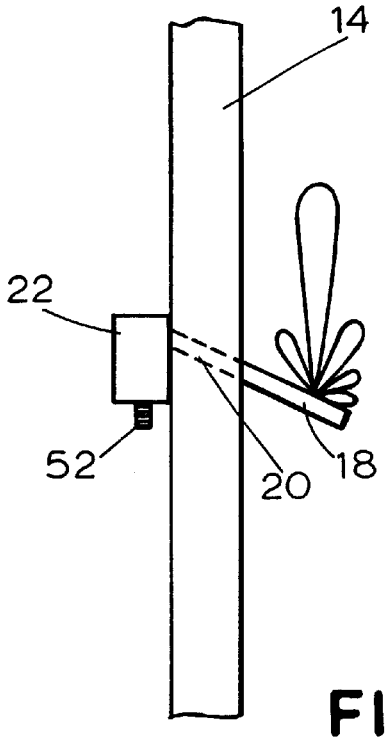
Figure 6C:
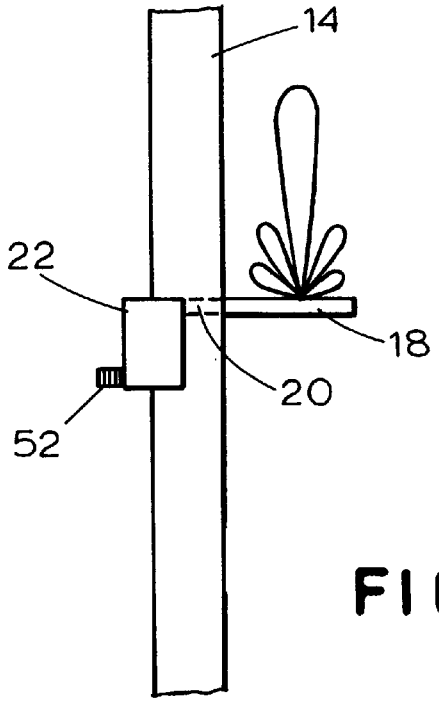

Referring now to FIGS. 6A–6C, methods of installing the receiver system 16 in the wall 14 of the MDU 10 will be described. In each of these cases, an installer on the inside of the MDU 10 first drills or otherwise cuts a hole into the wall 14 large enough for the antenna 18, the radome 40, and the support mount 44 to fit therethrough. The installer then simply inserts the antenna 18 into the hole and slides the antenna 18 through the hole until the antenna 18 is positioned on the exterior of the wall 14 and the downconverter 22 is flush with the interior surface of the wall 14. Preferably, at this point, the adapter 20 is entirely disposed within the hole in the wall 14. Likewise, the waveguide 26 is preferably long enough to assure that the slots 28 of the antenna 18 are all outside of the wall 14. The downconverter 22 can then be electrically connected via the coupling 52 to a decoder or demodulator associated with the signal being received. As illustrated in FIG. 6A, the hole in the wall 14 may be cut so that the antenna 18 is disposed perpendicularly to the exterior surface of the wall 14. In this case, the antenna 18 may have a beam pattern with a maximum gain lobe perpendicular to the upper surface of the antenna 18 to receive signals that are propagating along the exterior wall 14 from, for example, a transmitter located on the roof of the MDU 10. Of course, the receiver system 16 can be rotated to point the beam thereof towards the ground or any other position at which a transmitter is located. The receiver system 16 may then be sealed to the wall and mounted in place in any desired manner.

As illustrated in FIG. 6B, the hole in the wall 14 may be cut so that the antenna 18 is disposed at an acute angle with respect to the exterior surface of the wall 14. In this case, the antenna 18 may have a beam pattern with a maximum gain lobe at an acute (non-perpendicular) angle with respect to the upper surface of the antenna 18 so that the antenna 18 is configured to receive signals from a transmitter located on the roof of the MDU 10, as illustrated in FIG. 6B. Of course, in this case, the hole must be drilled in the wall 14 at a predetermined angle with respect to the surface of the wall 14. The installation configuration of FIG. 6B is especially useful in assuring that, for example, rain and snow do not accumulate on the antenna 18. Likewise, this configuration may help to prevent birds or other animals from roosting on the antenna 18.

Referring now to FIG. 6C, the receiver system 16 may also be installed such that the downconverter 22 is disposed in a depression or a recess formed in the interior surface of the wall 14. This configuration enables the waveguide 26 and/or the adapter 20 to be shorter which, in turn, decreases the insertion loss between the antenna 18 and the downconverter 22.

Of course, the waveguide antenna 18 and/or the adapter 20 may be any desired length to fit through the wall 14. However, to reduce the noise temperature of the receiver system 16, the adapter 20 and the first gain stage of the downconverter 22 can be placed directly after the antenna 18 by shaping the radome 40 and/or the support mount 44 to accommodate an amplifier circuit. Still further, because the antenna 18 only protrudes about 3 inches from the wall 14, typical window washing equipment used in high-rise buildings will generally be able to clear the antenna 18 after it has been installed.

As will be understood, because the antenna 18, the adapter 20, and the downconverter 22 are all formed on a single substrate that can be manufactured and cut to fit, the entire receiver system 16 is easily manufactured or milled at the same time, which makes the receiver system 16 compact and less expensive to produce as compared to other types of waveguide slot antennas and waveguide-to-microstrip transition stages known in the art. Still further, with the integrated waveguide antenna, adapter, and downconverter configuration described herein, the receiver system 16 can be easily installed through a hole in a wall from an interior portion of a building, i.e., without having to climb onto the outside of a building. Moreover, the antenna described herein is low in profile which reduces the negative aesthetic effects of mounting that antenna on an exterior portion of a building.

The present invention has been described with reference to specific examples, which are intended to be illustrative only, and not to be limiting of the invention. It will be apparent to those of ordinary skill in the art that changes, additions, and/or deletions may be made to the disclosed embodiments without departing from the spirit and scope of the invention.

What is claimed is:

1. A waveguide-to-stripline adapter comprising:

a planar continuous piece of dielectric substrate having a plurality of sides, wherein a first side is of a first width; and a metal layer disposed on each of the plurality of sides of the substrate, wherein the metal layer on the first side of the substrate includes a tapered section having a first portion having a first width and a second portion having a second width and that tapers from the first width at one part of the substrate to a second width that is smaller than the first width at another part of the substrate, wherein the second portion of the tapered section is connectable to a microstrip line formed on the same piece of dielectric substrate, and further including a dielectric loaded waveguide that is formed on the same piece of dielectric substrate and that is connected to the tapered section.

2. The waveguide-to-stripline adapter of claim 1, wherein the waveguide comprises an antenna.

3. The waveguide-to-stripline adapter of claim 1, wherein the waveguide comprises a slot array antenna.

4. The waveguide-to-stripline adapter of claim 1, wherein the tapered section comprises a linear taper.

5. The waveguide-to-stripline adapter of claim 1, wherein the substrate comprises a continuous piece of polytetrafluoroethylene.

6. The waveguide-to-stripline adapter of claim 1, wherein the first side of the substrate has two edges along the length thereof and a center and wherein the tapered section tapers away from each of the two edges at the one part of the substrate towards the center at the another part of the substrate.

7. The waveguide-to-stripline adapter of claim 1, wherein the metal layers on second, third, and fourth sides of the substrate substantially cover the second, third, and fourth sides of the substrate.

8. The waveguide-to-stripline adapter of claim 1, further including a downconverter that is formed on the substrate and that is connected to the microstrip line to downconvert signals on the microstrip line.

9. A waveguide-to-stripline adapter integrally formed on a substrate adjacent to and coplanar with a waveguide antenna and a downconverter by a process comprising the steps of:

providing a dielectric substrate having upper and lower surfaces and two side surfaces;

coating said upper and lower surfaces with a layer of metal;

cutting said substrate into strips of appropriate widths respectively for the waveguide antenna, the adapter and the downconverter;

cutting the edges of each strip so that the substrate has the desired width at those locations;

coating the sides of the substrate associated with the adapter with a metal layer;

processing the upper surface of the adapter and waveguide antenna to expose the surface of the substrate at the appropriate location and form a tapered metal layer on the adapter and form slots of the waveguide antenna.

10. The adapter of claim 9 wherein the dielectric substrate comprises polytetrafluorethylene.

11. The adapter of claim 9 wherein the tapered metal layer tapers from a first width at one part of the substrate to a second width that is smaller than the first width at another part of the substrate.

12. The adapter of claim 11, wherein the adapter at the end having the second width is connected to a microstrip line.

* * * * *